US011473764B1

(12) United States Patent
Luk et al.

(10) Patent No.: US 11,473,764 B1
(45) Date of Patent: Oct. 18, 2022

(54) LED DOWNLIGHT WITH ENHANCED FEATURES

(71) Applicant: Lighting & Supplies, Inc., Brooklyn, NY (US)

(72) Inventors: John Luk, Flushing, NY (US); Joel Gross, Brooklyn, NY (US); Timothy Hill, New York, NY (US)

(73) Assignee: Lighting & Supplies, Inc., Brooklyn, NY (US)

( * ) Notice: Subject to any disclaimer, the term of this patent is extended or adjusted under 35 U.S.C. 154(b) by 0 days.

(21) Appl. No.: 17/731,234

(22) Filed: Apr. 27, 2022

Related U.S. Application Data

(60) Provisional application No. 63/201,404, filed on Apr. 28, 2021.

(51) Int. Cl.
*F21V 23/00* (2015.01)
*F21S 8/02* (2006.01)
*F21Y 115/10* (2016.01)

(52) U.S. Cl.
CPC ..... *F21V 23/008* (2013.01); *F21S 8/026* (2013.01); *F21V 23/002* (2013.01); *F21Y 2115/10* (2016.08)

(58) Field of Classification Search
CPC ..... F21V 23/008; F21V 23/002; F21S 8/026; F21Y 2115/10
See application file for complete search history.

(56) References Cited

U.S. PATENT DOCUMENTS

2008/0054135 A1* 3/2008 Galasso ..... H02G 3/185 248/201
2008/0180961 A1* 7/2008 Gibson ..... F21V 15/01 362/364
2015/0153025 A1* 6/2015 Wu ..... F21V 21/046 362/282
2019/0072258 A1* 3/2019 Tan ..... F21K 9/20

FOREIGN PATENT DOCUMENTS

WO WO-2016203125 A1 * 12/2016 ..... F21L 14/02

OTHER PUBLICATIONS

English translation of WO-2016203125-A1 Meskaoui, published Dec. 2016 (Year: 2016).*

* cited by examiner

*Primary Examiner* — Evan P Dzierzynski
(74) *Attorney, Agent, or Firm* — Bochner IP, PLLC; Andrew D. Bochner

(57) ABSTRACT

The present invention may be directed to an improved LED downlight with enhanced features including a multi-adjustable junction box and cover assembly, and arm and hinge mechanisms for better installation and packaging of said improved LED downlight. The versatile configuration of the junction box, mounting plate arm, and hinge mechanisms may allow the entire assembly to be maneuvered over various sized ceiling holes for ease of driver and LED replacement and maintenance. Other features and improvements may include compact compressible and expandable three-piece hangar bar mounting brackets, an integral air-tight box, and/or a system for mounting the improved LED downlight to various ceiling thicknesses. The improved LED downlight may be used in both new construction and remodel retrofit installations, sharing the majority of parts, providing ease and flexibility for the installer.

20 Claims, 7 Drawing Sheets

LED DOWNLIGHT WITH ENHANCED FEATURES

CLAIM OF PRIORITY

This application claims priority from U.S. Provisional Patent Application No. 63/201,404, filed on Apr. 28, 2021, the contents of which are incorporated herein by reference.

FIELD OF THE INVENTION

The present invention relates to an improved recessed LED downlight with enhanced features that is configurable for both new construction installations and remodel retrofit installations in either residential or commercial applications.

INTRODUCTION

LED recessed downlights are widely available from many manufacturers in sizes including 1", 2", 3", 4", 5", 6", 8", and even up to 10" diameters, for use in both commercial and residential installations. Typically, a different fixture is offered for either a new construction installation or a remodel retrofit installation in the various sizes, but may share similar trims and the same LED light modules. There becomes a first need for one downlight fixture that can be easily adapted to work in a new construction application or in a remodel retrofit application by sharing similar structural components with minimal additional and accessory parts for the particular installation needed.

In some installations, and in particular in residential homes where the joists may be set at 12-inch centers, the larger diameter units present a challenge. Specifically, such larger diameter units may not fit into a smaller space. Furthermore, many homes have very low ceiling height clearances, as well. Such low ceiling clearances manifest difficulty in trying to fit LED downlights into such spaces. Accordingly, there is an immediate second need for an improved and versatile downlight fixture that can be installed into tight spaces thereby eliminating the size restrictions and limitations of use.

In addition, currently there is no simple or practical procedure for the smaller diameter light heads (for example, 1", 2", and 3" units) to be easily repaired. Moreover, such small units create difficulty in the replacement of LED drivers and/or light engines from below the ceiling. Such repair limitations are caused by the ceiling hole cutout being too small to receive an individual's hand. In effect, there is no ability from below to access to the junction box or manipulate the LED electronics without being forced to rip open and damage the ceiling. Yet, further, such a destructive entry requires that same individual to patch and paint the ceiling again. So, there becomes a third need for an improved downlight fixture that can be easily maintained and repaired, allowing access to the internal electronics from below the ceiling without having to damage the existing ceiling.

Lastly, ceilings are typically covered using sheet rock of varying thicknesses, fastened to the ceiling joists using wood or sheet metal screws. In residential homes, the minimum thickness sheet rock may be ⅜" thick, and can comprise double sheets of up to ⅞" thick for noise muffling and fire suppression at a combined maximum thickness of 1.750". Thus, there is a need for an improved downlight to have the ability to be installed into ceilings with thicknesses in the range of 0.375" up to 1.750", and any ceiling thicknesses in between.

The present invention overcomes all of the above issues and problems with existing downlight fixtures by providing many enhanced features in the design and installation methods in a family of improved downlight fixtures. The various embodiments of the present inventions will offer all these advantages and improvements over existing downlight fixtures that are presently on the market today.

SUMMARY OF AN EMBODIMENT

The invention of the present disclosure may be a downlight comprising a junction box bound by one or more plate covers, where the junction box is attached to a first hinge mechanism, where the first hinge mechanism may be configured to swivel the junction box about the first hinge mechanism. The downlight may further include an arm attached to the first hinge mechanism and a second hinge mechanism attached to the arm, wherein the second hinge mechanism may be configured to swivel the arm about the second hinge mechanism. In a further aspect, the downlight may comprise an LED driver disposed on one of the one or more plate covers and an LED light engine module in electrical communication with the LED driver.

In a further embodiment, the downlight may comprise a tilt rotation ring holder attached to the LED light engine module; and a trim attached to the tilt rotation ring holder, where the trim is configured to allow a tilt adjustment and a pan adjustment of the LED light engine module via tactile actuation from below a receiving surface. In yet a further embodiment, the downlight may include an air tight box at least partially surrounding the LED light engine module and an output cable pigtail attached to the air tight box via a removable top electrical receptacle and a short length jumper, where the output cable pigtail may facilitate the electrical communication between the LED driver and the LED light engine module. The air tight box may be fastened by one or more flexible lock tabs located on a main support ring, and a hold down ring may secure a pan rotation ring to a main support ring. In a further aspect, one or more butterfly brackets may be attached to the hold down ring, and the one or more butterfly brackets may be sized to accept one or more compressible mounting arms.

In another embodiment, the LED light engine module further comprises at least a heat sink, one or more LED emitters, a holder, an optical lens, a retainer holder, and a reflector. The one or more plates may be affixed to the junction box via one or more tabbed springs. In one embodiment, the LED driver is disposed internal to the junction box. Alternatively, the LED driver may be disposed external to the junction box.

The invention of the present disclosure may be a downlight comprising a junction box disposed above a receiving surface, where the junction box comprises a mounting mechanism configured to fasten the junction box to a rigid surface. The downlight may further comprise an LED driver disposed within the junction box, an output cable pigtail extending from the LED driver, where the output cable pigtail may be configured to attach to a ring mount bracket, and a main support ring fastened to the ring mount bracket, where the output cable pigtail may connect to the ring mount bracket via a removable electrical receptacle connector that may be integral to a short length jumper. In an embodiment, the downlight further comprises an LED light engine module comprising a heat sink and one or more LED emitters, wherein pan and tilt movements of the one or more LED emitters are integral to the LED light engine module, a trim attached to the LED light engine module, the trim configured to enable adjustment of the LED light engine module from below the receiving surface, and one or more flexible spring clips attached to the trim. The one or more flexible spring clips may be configured to maintain the LED light engine module and the trim in position, and the one or more flexible clips may spread radially upon entry above the receiving surface.

In a further embodiment, the output cable pigtail is housed within a grounded flexible armor jacket. The downlight may further comprise a tabbed spring comprising one or more opposing tabs, where the tabbed spring may be configured to affix one or more plate covers to the junction box. In yet a further embodiment, the downlight may include one or more butterfly brackets attached to the main support ring, where the one or more butterfly brackets may be configured to accept one or more mounting arms. For example, the one or mounting arms may be compressible.

The invention of the present disclosure may be a downlight comprising a junction box sized to accept a plate cover, where the junction box may be attached to a hinge bracket. The downlight may further include an extension arm swivably attached to the hinge bracket, where the extension arm may be further attached to one or more hinge spring mount brackets, where the extension arm may be configured to swivel about the one or more hinge spring mount brackets, and where the hinge bracket may be configured to swivel about the extension arm. In an embodiment, the downlight may further include an LED driver disposed within the junction box, a COB holder comprising one or more attachment means, the one or more attachment means in contact with a heat sink; and a trim sized to interface with a receiving surface. The LED driver may be shielded by a driver protective cover. In an aspect, the downlight may further comprise a thermal element disposed between a COB LED emitter and the COB holder and the heat sink.

The invention of the present disclosure may be a method for accessing an LED driver for replacement comprising the following steps: remove an LED light engine from a receiving hole, wherein the receiving hole is bound by a receiving surface; pull on an electrical connection between the LED light engine and the LED driver through the receiving hole; swivel an arm via a second hinge mechanism, causing a first hinge mechanism to approach the receiving hole, wherein the arm is swivably attached to the second hinge mechanism; swivel a junction box via the first hinge mechanism, causing the junction box to approach the receiving hole, wherein the junction box is swivably attached to the first hinge mechanism; disengage a cover plate to access the LED driver from a junction box, wherein the cover plate is reversibly attached to the junction box; disengage a first electrical connection between the LED driver and LED light engine; disengage a second electrical connection between the LED driver and an input power; and remove the LED driver.

The method may further recite reinstallation of a replacement LED driver, where such a method comprises the steps of: engage the replacement LED driver to the junction box; engage the first electrical connection between the replacement LED driver to the LED light engine; engage the second electrical connection between the replacement LED driver to input power; attach the cover plate to the junction box; swivel the junction box about the first swivel mechanism, causing the junction box to distance from the receiving hole; swivel the arm about the second swivel mechanism, causing the arm to distance from the receiving hole; and deposit the LED light engine through the receiving hole.

Additional aspects related to this disclosure are set forth, in part, in the description which follows, and, in part, will be obvious from the description, or may be learned by practice of this disclosure.

It is to be understood that both the forgoing and the following descriptions are exemplary and explanatory only and are not intended to limit the claimed disclosure or application thereof in any manner whatsoever.

These and other aspects, features, and advantages of the present invention will become more readily apparent from the following drawings and the detailed description of the preferred embodiments.

TABLE OF NUMERALS

First Preferred Embodiment (FIG. 1)

10 LED downlight
20 Junction box
30A, 30B Metal plate covers
40 First hinge
50 Retractable Arm
60 Second hinge
70 LED light engine module
80 Optical axis center line
90 Output cable pigtail
100 Top electrical receptacle
110 Optional AT box
120 LED driver
130 Spring clip with opposing tabs
140 Short length jumper
150 Three flexible lock tabs
160 Main support ring
170 Hold down ring
180 Pan rotation ring
190 Ring mounting screws
200A, 200B Screw spring clips
210A, 210B Screw spring rivets
220 Tilt rotation ring holder
230A, 230B Flat head screws
240A, 240B Friction washers
250A, 250B Long coarse screws
260A, 260B Round internal star lock washers
270 Trim gasket
280 Trim
290A, 290B Butterfly brackets
300A, 300B 3-piece hangar bar mounting arms

Second Alternate Embodiment (FIG. 2)

310 LED downlight
320 Junction box
330A, 330B Metal plate covers
340 First hinge
350 Retractable arm
360 Second hinge
370 LED light engine module
380 Optical axis center line
390 Output cable pigtail
400 Top electrical receptacle
410 Optional AT box
420 LED driver
430 Spring clip with opposing tabs
440 Short length jumper
450 Three flexible plastic lock tabs
460 Main support ring
470 Hold down ring

480 Pan rotation ring
490A, 490B Flag lock arms
500 Ring mounting screws
510A, 510B Screw spring clips
520A, 520B Screw spring rivets
530 Tilt rotation ring holder
540A, 540B Flat head screws
550A, 550B Friction washers
560A, 560B Long coarse screws
570A, 570B Screw guide holes
580A, 580B Round internal star lock washers
590 Trim gasket
600 Trim Third Alternate Embodiment (FIG. 3)

610 LED downlight
620 Junction box
630A, 630B Metal plate covers
640 LED driver
650 Output cable pigtail
660 Ring mount bracket
670 Main support ring
680A, 680B Mounting means
690 Flexible metal armor jacket
700 Tabbed spring clip
710 Removable electrical receptacle connector
720 Short length jumper
730 Male/Female electrical connector pair
740 LED light engine module
750 Light engine electrical plug connector
760 Heat sink
770 COB LED
780 Holder
790 Optical lens
800 Retainer holder
810 Reflector
820 SCT electronics and switch
830 Trim
840A, 840B Flexible spring clips
850A, 850B Butterfly brackets
860A, 860B 3-piece hangar bar mounting arms Fourth Alternate Embodiment (FIG. 4)

870 LED downlight
880 Junction box
890 Metal plate cover
900 First hinge
910 Retractable Arm
920 Second hinge
930 LED light engine module
930A Heat sink
930B COB LED
930C Holder
930D Optical lens
930E Retainer holder
930F Reflector
940A SCT electronics
940B SCT switch
950 Optical axis center line
960 Output cable pigtail
970 Top electrical receptacle
980 Optional AT box
990 LED driver
1000 Spring clip with a release tab
1010 Main support ring
1020 Pan rotation hold down ring
1030 Ring mounting screws
1040A, 1040B Screw spring clips
1050A, 1050B Screw spring rivets
1060 Tilt rotation ring holder
1070A, 1070B Flat head screws
1080A, 1080B Friction washers
1090A, 1090B Long coarse screws
1100 Trim
1110A, 1110B Butterfly brackets
1120A, 1120B 3-piece hangar bar mounting arms Fifth Alternate Embodiment (FIG. 5)

1130 LED downlight
1135 LED light engine assembly
1140 LED driver
1150 Gasket
1160 Junction box
1170 Metal plate cover
1175A, 1175B Friction locking tabs
1180 Driver protective cover
1190 Trim
1200 Main COB holder
1205A, 1205B Mounting posts
1210 Twist-lock ring
1220 Heat sink
1230 Hinge bracket
1240 Extension arm hanger
1250 Glass lens
1260 Reflector
1270 COB LED emitter
1280A, 1280B Hinge spring mount brackets
1290A, 1290B Small pan head screws
1300A, 1300B Dowel pins
1310A, 1310B, 1310C, 1310D Flat head screws
1320A, 1320B, 1320C, 1320D Large pan head screws

BRIEF DESCRIPTION OF THE DRAWINGS

The incorporated drawings, which are incorporated in and constitute a part of this specification exemplify the aspects of the present disclosure and, together with the description, explain and illustrate principles of this disclosure.

DETAILED DESCRIPTION

Figure 1:
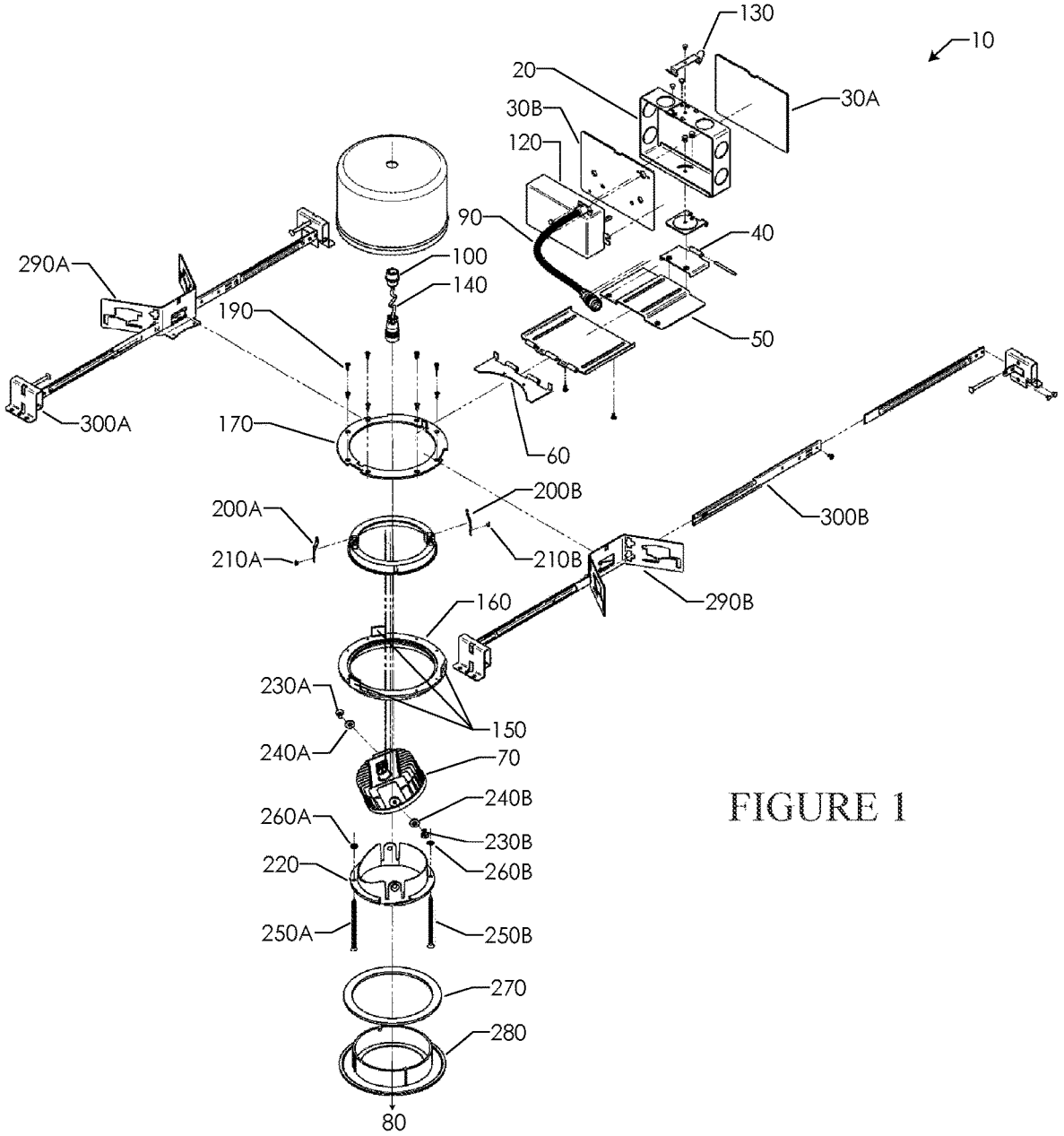
FIG. 1 is an isometric exploded view of a first embodiment of the present invention showing an improved 4" diameter LED downlight with enhanced features for a new construction installation.

In the following detailed description, reference will be made to the accompanying drawing(s), in which identical functional elements are designated with like numerals. The aforementioned accompanying drawings show by way of illustration, and not by way of limitation, specific aspects, and implementations consistent with principles of this disclosure. These implementations are described in sufficient detail to enable those skilled in the art to practice the disclosure and it is to be understood that other implementations may be utilized and that structural changes and/or substitutions of various elements may be made without departing from the scope and spirit of this disclosure. The following detailed description is, therefore, not to be construed in a limited sense.

It is noted that description herein is not intended as an extensive overview, and as such, concepts may be simplified in the interests of clarity and brevity.

All documents mentioned in this application are hereby incorporated by reference in their entirety. Any process described in this application may be performed in any order and may omit any of the steps in the process. Processes may also be combined with other processes or steps of other processes.

The present invention relates to an improved downlight that shares the same main parts including the ring, frame, junction box, etc. between the new construction and remodel retrofit units in the same fixture thereby reducing inventory SKU's and cost of additional materials. For example, the same rings in different diameter sizes can used. In a new construction installation, the ring may be installed with the flange trim on top of the ceiling, while in remodel retrofit installations, the ring may be flipped and installed with the flange trim now on the bottom, so that the fixture can be installed into a ceiling hole cutout from the bottom. Further, a new flat ring may be attached to the bottom of the new construction frame assembly to create a bottom flange that can be attached with long screws to the main ring frame assembly having retractable flag arms to capture the top of the ceiling surface as the two long screws are engaged into the pan rotation ring. Traditionally, downlight manufactures offer one fixture for new construction and another style of fixture for retrofit installations. Thus, it is desirable to provide a single fixture that may be installed in a new construction open ceiling or as a retrofit fixture in a closed ceiling. Accordingly, the same lip ring may be utilized in both applications. In an embodiment, for a new construction, the lip ring sits with the lip on top as it sits on the upper top surface of the ceiling. Conversely, for retrofit installation, the lip ring may be reversed and may be pushed up into the ceiling where the lip rests on the lower bottom surface of the ceiling to prevent the unit from entering entirely into the ceiling hole.

The subject invention reduces the inconvenience caused by tight spaces during installation by providing an improved downlight fixture that allows the normally fixed junction box to rotate and fold over multi-adjustable means, allowing the fixed junction box to be configured in many positions. In a further embodiment, the supporting extension arm connecting the main ring to the junction box is retractable, allowing the unit to be made even more compact to fit into a tighter ceiling space. The compact package may also provide cost savings during packaging and shipping of the improved downlight due to the reduced configurable volume package size. Lastly, in an embodiment, the mounting hanger bars are specifically configured into three compact parts that aid in reducing the overall shipping package size as well. The improved hanger bars may be compressed to fit residential 12-inch center-to-center joists, and may be extended to fit into 24-inch center-to-center commercial T-grids.

In general, the smaller 1", 2", and 3" diameter LED light engine downlights of the present invention may be made available with a smaller sized junction box and covers that allow for the driver electronics to be easily pulled down from the main fixture ring through the ceiling hole cutout in order to change out the driver if necessary. In an embodiment, this may be accomplished by pulling the short pigtail from the junction box down through the hole and out to disengage a mechanical lock spring clip that holds the junction box and covers, and completely removing the entire junction box assembly out of the hole for access to the inside driver for replacement. Reinserting the entire junction box assembly through the ceiling hole and onto the collapsible metal articulating frame assembly may return the junction box assembly to its functional position.

Further, existing downlights are designed only to fit within a specific ceiling thickness. When the ceiling is too thick or the light engine is recessed too far up into the ceiling, the existing trims and spring clips may not properly engage and can cause the existing trims to hang loose or even separate from the ceiling surface causing light leak and improper installations. To compensate for this, the improved downlight fixture of the present invention may eliminate this restriction and may be designed to work with a wide range of different ceiling thicknesses to keep the proper tension on the mounting spring clips, or other securing mechanism, and to ensure the trims lay flat to the bottom ceiling surface for a tight seal without light leak.

In a first embodiment of the present invention, an improved LED downlight is disclosed for use in new construction installations. Installation of the LED downlight in this embodiment may be from above the ceiling. The improved LED downlight may include a 90-degree swivel of the junction box and covers with a first hinging mechanism to allow the junction box to be laid flat in parallel or perpendicular to the ceiling surface at the longest stretch. A retractable arm with a second hinging mechanism allows the junction box and covers to be pulled in closer and in center line to the LED light engine flat optical center axis just above the ceiling hole cutout. Throughout this disclosure, the "retractable arm" may be referred to herein as simply the "arm." In an embodiment, the junction box rotation is limited in its movement such that wiring internal to the junction box does not twist or tangle, causing undue stress on the wires (for example, manifesting as an electrical shock hazard). Thus, the pigtail connection cable may be sufficiently long to allow the hinge mechanisms and junction box to operate at their extended positions.

A low-voltage driver output cable pigtail may be provided that connects to the top of an Air-Tight AT box from the junction box and cover. The length of this cable pigtail may be approximately half the length of the fully extended fixture or about 12-18 inches long. The LED driver can be mounted internal or external to the junction box on one or more junction box cover plates. A single spring with opposing tabs may help to lock and hold the junction box cover plates in place. However, in further embodiments, the junction box may include more than one springs having opposing tabs. Other means of securing the junction box cover plates include, but are not limited to, the use of screws, snaps, and twist-and-lock. The LED driver may be replaced by removing it from the junction box through the ceiling hole cutout.

In an embodiment, the LED driver cable pigtail connects to the top of the optional AT box by way of a removable connector that is part of a short length jumper that connects the LED driver to the LED light engine located inside the optional AT box. The optional AT box may be held in place by three flexible clips located on a main support ring. A hold down ring may secure a pan rotation ring to the main support using screws. Two spring clips may be fastened to opposing sides of the pan rotation ring by low profile closed end type rivets or nuts and bolts.

In an embodiment, an LED light engine module is used in a first embodiment of the present invention. The LED light engine module may comprise a heat sink, Chip on board ("COB") or LED emitter(s), LED holder, optical lens, retainer, reflector, and Selectable Color Temperature ("SCT") electronics and switching means or fixed discrete colors. The LED light engine module may be attached to a tilt rotation ring with two flat head and friction washers. Two long coarse thread screws may be provided on the tilt rotation ring and may be held captive in place with a round internal star lock washer. In an embodiment, a separate ring gasket and trim is provided that attaches to the tilt rotation ring and allows for the smooth pan and tilt rotation of the entire LED light engine module that can be adjusted from below the ceiling during focusing of the improved recessed LED downlight. For example, the user may exert pressure upon the trim or other component of the downlight in order to adjust the tilt or pan settings of said downlight. Further, for example, the user may utilize tactile manipulation to alter the tilt and/or pan position of the LED light engine module. The trim gasket may be used to make the light and components thereof rated for use in a bathroom for example, and the trim may be available in both round and square shapes. The tilt adjustment of any downlight described herein may refer to the LED light engine module's motion in a single axis. The pan adjustment of any downlight described herein may refer to the LED light engine module's rotational movement. Thus, by combining tilt and pan adjustments, the light emitted from the LED light engine module may be directed in a wide range of desired directions.

To complete the first embodiment of an improved recessed LED downlight for new construction installations, two butterfly brackets may be attached to opposing sides of the hold down ring to accept a 3-piece hanger bar arm for use with residential 12" and commercial 16" joist spacings, as well as 24" T-grids. The 3-pieces may be compressed to roughly 8" in total length and extended up to 24", offering versatile mounting of the LED downlight in all types of ceiling arrangements.

In an alternate second embodiment of the present invention, an improved LED downlight is disclosed for use in remodel retrofit applications. Installation of the LED downlight in this embodiment may be from beneath the ceiling. The improved LED downlight may include a 90-degree swivel of the junction box and covers with a first hinging mechanism to allow it to be laid flat in parallel or perpendicular to the ceiling surface at the longest stretch. A retractable arm with a second hinge mechanism may allow the junction box and covers to be pulled in closer to the LED light engine flat optical center axis, extending vertically just above the ceiling hole cutout.

In an embodiment, a low-voltage driver output cable pigtail is provided that connects to the top of an Air-Tight AT box from the junction box and cover. The length of this cable pigtail may be approximately half the length of the fully extended fixture or about 12-18 inches long. The LED driver can be mounted internal or external to the junction box on one junction box cover plate. A single spring with opposing tabs may help to lock and hold the junction box cover plates in place. Other means of securing the junction box cover plates include, but are not limited to, the use of screws, snaps, twist-and-lock. The LED driver may be replaced by removing it from the junction box through the ceiling hole cutout.

The LED driver cable pigtail may connect to the top of the optional AT box by way of a removable connector that is part of a short length jumper that connects the LED driver to the LED light engine located inside the optional AT box. In an embodiment, the optional AT box is held in place by three flexible clips located on a main support ring. A hold down ring may secure a pan rotation ring to the main support using screws. Two spring clips may be fastened to opposing sides of the pan rotation ring by low profile closed end type rivets or nuts and bolts. The pan rotation ring may include at least two retractable flag arms that are released when the two long screws are inserted into the two guide screw holes provided on the pan rotation ring.

In an embodiment, an LED light engine module is used in this first embodiment of the present invention. The LED light engine module may comprise a heat sink, COB or LED emitter(s), LED holder, optical lens, retainer, reflector, and Selectable Color Temperature (SCT) electronics and switching means or fixed discrete colors. The LED light engine module may be attached to a tilt rotation ring with one or more screws and friction washers. Two long coarse thread screws may be provided on the tilt rotation ring and may be held captive with a round internal star lock washer. A separate trim gasket and trim may be provided that attaches to the tilt rotation ring and may allow for the smooth pan and tilt rotation of the entire LED light engine module (for example, enabling adjustment from below the ceiling during focusing of the improved recessed LED downlight). In an embodiment, the trim gasket is used to make the luminaire WET LOCATION rated for use in a bathroom for example. The trim may be available in both round and square shapes.

In an alternate third embodiment of the present invention, an improved alternate LED downlight is disclosed for use in new construction installations. Installation of the LED downlight in this embodiment is also from above the ceiling. The junction box and covers are now articulated in multiple locations and positions by using only a flexible low-voltage driver output cable pigtail instead of metal plates with hinges and rotations.

In an alternate third embodiment of the present invention, a low-voltage driver output cable pigtail is provided that connects to a ring mount bracket from the junction box and cover. The junction box may have mounting means for permanent installation of the junction box and cover to a fixed and rigid surface, such as a joist or beam. Further the cable pigtail may be housed in a flexible metal shell that is properly connected to AC ground for continuity and electrical safety. The length of this cable pigtail may be roughly 12-18 inches long. The LED driver can be mounted internal or external to the junction box, for example to the junction box cover plate. A single spring with opposing tabs may help to lock and hold the junction box cover plates in place. Other means of securing the junction box cover plates include, but are not limited to, the use of screws, snaps, twist-and-lock. The LED driver may be replaced by removing it from the junction box through the ceiling hole cutout. In an embodiment, the LED driver cable pigtail connects to the ring mount bracket by way of a removable connector that is a component of a short length jumper that connects the LED driver to the LED light engine.

An LED light engine module may also be used in this third alternate embodiment of the present invention. The LED light engine module may comprise a heat sink, COB or LED emitter(s), LED holder, optical lens, retainer, reflector, and Selectable Color Temperature (SCT) electronics and switching means or fixed discrete colors. Pan and tilt movements of the LED light source may be built into the LED light engine module in this alternate embodiment. The downlights may be configured as fixed focus LED downlights, for example, comprising no pan or tilt adjustments. Such fixed downlights may be adapted for flat ceiling installation. In an embodiment, the pan and tilt adjustments are provided on a gimbal unit that can be installed in flat or sloped ceilings. Such downlights may provide for an increased light focusing ability. In an embodiment, a separate ring gasket and trim is provided that attaches to the entire LED light engine module, wherein said module can be adjusted from below the ceiling during focusing of the improved recessed LED downlight. The ring gasket may be used to make the luminaire WET LOCATION rated for use in a bathroom for example. The trim may be available in both round and square shapes. In an embodiment, special spring clips are attached to opposing sides of the trim to hold the LED light engine and trim assembly in the ceiling with a twist to engage and spread the two flexible spring clips.

In an embodiment, to complete this alternate third embodiment of an improved recessed LED downlight for new construction installations, two butterfly brackets may be attached to opposing sides of the hold down ring to accept a special 3-piece hanger bar arm for use with resident 12" and commercial 16" joist spacings, as well as 24" T-grids. The 3-pieces can be compressed down to about 8" in total length, and extended up to 24" offering versatile mounting of the LED downlight in all types of ceiling arrangements. However, for the purposes of this disclosure, mounting arms may be provided capable of extending or compressing to any dimensions that facilitate mounting to either residential or commercial ceilings.

In one embodiment, the method and procedure for accessing the LED driver for replacement follows: (a) the trim and trim gasket is removed by a using a twist and turn pull to release motion; (b) unscrew the two long screws to drop the LED light engine; (c) pull the LED light engine down to get to the rear pigtail connector; (d) remove the pigtail from the LED light engine; (e) push up on the optional AT box leaving the pigtail attached to the inside of the optional AT box and set aside; (f) reach in and remove the connector from the top of the optional AT box; (g) reach in and disengage the LED driver and junction box cover plate; (h) pull the pigtail and LED driver and junction box metal plate cover out of the hole to replace the LED driver; and (i) reinstall all parts back into the ceiling in reverse order.

FIG. 1 is an isometric exploded view of a first embodiment of the present invention showing an improved 4" diameter LED downlight 10 with enhanced features for a new construction installation. However, this embodiment may utilize an LED downlight of any suitable diameter. In this first embodiment of the present invention, an improved LED downlight 10 is disclosed for use in new construction installations. Installation of the LED downlight 10 in this embodiment is from above the ceiling. For the purposes of this disclosure, the ceiling may be a receiving surface, where the receiving surface may have an upper face and a lower face. For example, the upper face may be "above the ceiling" and the lower face may be "below the ceiling." Further, the receiving surface may include a hole or an aperture configured to accept the LED downlight 10 or components thereof. The improved LED downlight 10 may include a 90-degrees swivel of a junction box 20 and metal plate covers 30A/30B. However, the LED downlight 10 may include a junction box 20 with swivel capabilities exceeding 90-degrees, for example, 360-degrees. Thus, the junction box 20 may be completed rotated about the first hinge 40. The junction box 20 may include any number or of combination of plate covers. In one embodiment, the junction box 20 includes four sides, where the plate covers 30A/30B are sized to be received by the junction box 20, forming a fifth and sixth side when assembled. Further, the junction box 20 may be in contact with a first hinge 40 mechanism to allow the junction box 20 to be laid flat in parallel or perpendicular to the ceiling surface at the longest expansive stretch of all parts. For example, the first hinge 40 mechanism may be attached to a bottom surface of the junction box 20. The first hinge 40 may allow the junction box 20 to be converted from a first position to a second position, wherein the first and second positions reflect whether the junction box 20 is parallel or perpendicular to the receiving surface.

The junction box 20 may include one or more holes or apertures configured to accept fasteners or to allow for travel of cables. Further, the one or more plates 30A/30B may include a number of holes, such that the contents of the junction box 20 may be in communication with peripherals external to the junction box 20. For example, such holes may allow for cables to carry information or electricity to and/or from the junction box 20. However, in another embodiment, the junction box 20 may be uniformly sealed. Although, if required by a particular embodiment, the junction box 20 or covers 30A/30B may include holes that are filled by required cables, such as pigtail 90.

In an embodiment, a retractable arm 50 with a second hinge 60 mechanism allows the junction box 20 and metal plate covers 30A/30B to be pulled in closer to the LED light engine module 70 flat optical axis center line 80 just above the ceiling hole cutout. The retractable arm 50 may be composed of a single member or two members. For example, as shown in FIG. 1, the retractable arm 50 may include two members, wherein the top member is attached to the first hinge 40 mechanism and the bottom member is attached to the second hinge 60 mechanism. In an embodiment, the retractable arm 50 comprising two members may allow for increased movement and/or reach of the junction box 20. Accordingly, the retractable arm 50 may be sized to accept the hinge component of the second hinge 60 mechanism. However, in various alternate embodiments, the junction box 20 may be disposed in proximity to the LED light engine module 70 without provision of the aforementioned intermediary components.

An LED driver 120 low-voltage output cable pigtail 90 may be provided that connects to the top electrical receptacle 100 of an optional Air-Tight AT box 110 from the junction box 20 and metal plate covers 30A/30B. In an alternate embodiment where there is no Air-Tight AT box 110, the LED driver 120 may more directly connect to the LED light engine module 70. In an embodiment lacking the AT box 110, the internal pigtail cable 90 may be excluded. In such an embodiment, the LED driver 120 output wires may be connected directly to the LED light engine 70. Alternatively, an AC DOB LED light engine may be utilized configured for use with discrete LED emitters and COB emitters that do not use a remote AC driver. In such embodiments, these boards have Drivers-On-Board configured to convert AC and DC voltages to power the DC LEDs. In such a case, the AC input power wires may attach directly to these aforementioned categories of AC LED boards. The Air-Tight AT box 110 may be a hollow or semi-hollow member configured and sized to accept at least the LED light engine module 70. For example, the Air-Tight AT box 110 may be a plastic member, but may also be composed of any suitable material. In one embodiment, the Air-Tight AT box 110 may be heat resistant, such that heat emanating from any of the components therein does not deform or damage the Air-Tight AT box 110. The Air-Tight AT box 110 may include a main opening sized to accept the LED light engine module 70, but may include a second opening sized to accept the top electrical receptacle 100 and/or the short length jumper 140. In such an embodiment, the second opening may form a seal with the components disposed through said opening, such that the inside portion of the Air-Tight AT box 110 is "air tight" from the environment. Similarly, the main opening may be sufficiently sealed once mated with the components described below. In an embodiment, the length of the output cable pigtail 90 is approximately half the length of the fully extended fixture or about 12-18 inches long. However, the output cable pigtail 90 may be any suitable length. The output cable pigtail 90 may be any cable material suitable for carrying electric current to power an LED. The LED driver 120 may be mounted internal or external to the junction box 20 on either metal plate covers 30A/30B. Accordingly, one or more of the plate covers 30A/30B may include features, such as holes, configured to accept fasteners of the LED driver 120. A single spring with opposing tabs 130 may help to lock and hold the junction box 20 metal plate covers 30A/30B in place. Other means of securing the junction box 20 metal plate covers 30A/30B include, but are not limited to, the use of screws, snaps, and twist-and-lock. In an embodiment, the LED driver 120 is replaced by removing it from the junction box 20 through the ceiling hole cutout. For example, the LED driver 120 may be sized such that it may be removed through the hole in the receiving surface sized to accept the downlight 10. Thus, at least one of the dimensions of the junction box 20 may be smaller than the diameter of the downlight 10 and/or the mounting hole in the ceiling.

In an embodiment, the LED driver 120 output cable pigtail 90 connects to the top of the optional AT box 110 by way of a removable top electrical receptacle 100. The removable top electrical receptacle 100 may be a component of or in conjunction with a short length jumper 140 that connects the LED driver 120 to the LED light engine module 70 located inside the optional AT box 110. The optional AT box 110 may be held in place by three flexible lock tabs 150 located on a main support ring 160. In an embodiment, the flexible lock tabs 150 may extend from the circumference of the main support ring 160. In a further embodiment, each of the flexible lock tabs 150 is disposed equidistant from adjacent flexible lock tabs 150. A hold down ring 170 may secure a pan rotation ring 180 to the main support ring 160 (for example, using ring mounting screws 190). In an aspect, two screw spring clips 200A/200B are fastened to opposing sides of the pan rotation ring 180 (for example, via low profile closed end type screw spring rivets 210A/210B or with nuts and bolts).

An LED light engine module 70 may be used in this first embodiment of the present invention. In such an embodiment, the LED light engine module 70 consists of a heat sink, COB or LED emitter(s), LED holder, optical lens, retainer, reflector, and/or Selectable Color Temperature (SCT) electronics and switching means or fixed discrete colors. The LED light engine module 70 may be attached to a tilt rotation ring holder 220 with two flat head screws 230A/230B and friction washers 240A/240B. In such an embodiment, the LED light engine module 70 includes one or more mounting points around the perimeter of the LED light engine module 70, wherein the mounting points are configured to accept screws 230A/230B. Further, in such an embodiment, the mounting points and the screws 230A/230B may be disposed such that the LED light engine module 70 may be titled about the axis formed by the screws 230A/230B. Two long coarse thread screws 250A/250B may be provided on the tilt rotation ring holder 220, and each may be held captive with a round internal star lock washer 260A/260B. However, in alternate embodiments, the screws 250A/250B may not be held captive. Further, any suitable style, shape, size, or number of lock washers may be utilized. A separate trim gasket 270 and trim 280 may be provided that is configured to attach to the tilt rotation ring holder 220, and may allow for the smooth pan and tilt rotation of the entire LED light engine module 70, such that it may be adjusted from below the ceiling during focusing of the improved recessed LED downlight 10. In such an embodiment, upward pressure actuated on the trim 280 may cause the LED light engine module 70 to tilt and/or pan. The trim gasket 270 may be used to make the luminaire WET LOCATION rated, or otherwise water resistant or water proof, for use in a bathroom for example. Moreover, the trim 280 may be available in round, squares, or other suitable shapes.

In an embodiment, to complete assembly of the first embodiment of an improved recessed LED downlight 10 for new construction installations: two butterfly brackets 290A/290B may be attached to opposing sides of the hold down ring 170, where the two butterfly brackets 290A/290B are sized to accept mounting means or mounting arms (for example, 3-piece hanger bar mounting arms 300A/300B). The mounting arms 300A/300B may be configured for use with residential 12" and commercial 16" joist spacings, as well as 24" T-grids. The 3-piece hangar bar mounting arms 300A/300B may be compressed to roughly 8" in total length and extended up to roughly 24". Such mounting arms 300A/300B may offer versatile mounting of the improved recessed LED downlight 10 in all types of ceiling arrangements. Further, as the mounting arms 300A/300B may be compressible, such mounting arms 300A/300B may more easily be introduced through receiving surface holes and/or manipulated with relative ease once above the receiving surface.

For the purposes of this disclosure, similar elements, limitations, parts, or components of downlights of the various embodiments recited herein may further share component-specific characteristics across said various embodiments. For example, the geometries or structure described herein for junction box 20 may be replicated in junction box 320. Thus, the characteristics of components should not be read as limiting to the embodiment of descriptive origin.

Figure 2:
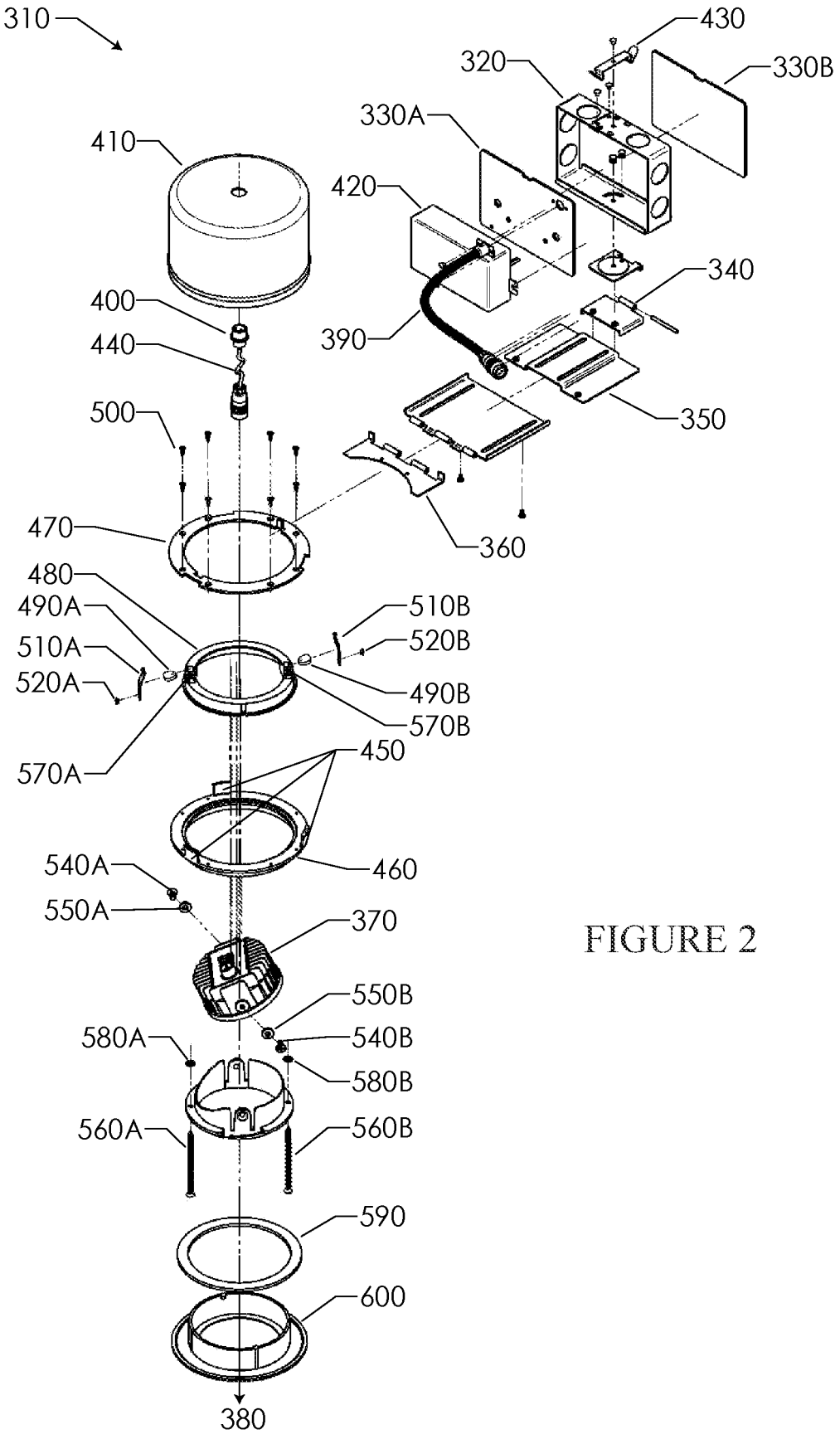
FIG. 2 is an isometric exploded view of a second embodiment of the present invention showing the improved LED downlight with enhanced features for a remodel retrofit installation.

FIG. 2 is an isometric exploded view of an alternate second embodiment of the present invention showing the improved LED downlight 310 with enhanced features for a remodel retrofit installation. In this alternate second embodiment of the present invention, an improved LED downlight 310 is disclosed for use in remodel retrofit applications. Installation of the LED downlight 310 in this embodiment may be from below the receiving surface (for example, from under the ceiling). In an embodiment, the improved LED downlight 310 may include a 90-degree swivel of the junction box 320 and metal plate covers 330A/330B with a first hinge 340 mechanism to allow improved LED downlight 310 to be laid flat in parallel or perpendicular to the ceiling surface at the longest stretch. A retractable arm 350 with a second hinge 360 mechanism may allow the junction box 320 and/or metal plate covers 330A/330B to be pulled or withdrawn towards the LED light engine module 370 flat optical axis center line 380 just above the ceiling hole cutout.

An LED driver 420 low-voltage output cable pigtail 390 may be provided, where the pigtail 390 is configured to connect to the top of an optional Air-Tight AT box 410 from the junction box 320 and metal plate covers 330A/330B. The length of the output cable pigtail 390 may be approximately half the length of the fully extended fixture or roughly 12-18 inches long. However, the output cable pigtail 390 may be any suitable length. The LED driver 420 may be mounted internal or external to the junction box 320 on either metal cover plates 330A/330B. A single spring clip with opposing tabs 430 may aid in locking and holding the junction box 320 metal cover plates 330A/330B in position. For example, application of pressure to the opposing tabs 430 may cause the tabs 430 to release one or more of the metal cover plates 330A/330B. Similarly, application of pressure to metal cover plates 330A/330B, when the plates 330A/330B are adjacent to the junction box 320, may cause the opposing tabs 430 to capture the metal cover plates 330A/330B. Further, although the metal cover plates 330A/330B are described herein as "metal," such plates may be composed of any suitable material. Other means of securing the junction box 320 metal cover plates 330A/330B include, but are not limited to, the use of screws, snaps, twist and lock, etc. The LED driver 420 may be replaced by removing it from the junction box 320 through the ceiling hole cutout. Accordingly, the LED driver 420 may be sized such that at least one dimension of the LED driver 420 is smaller than the diameter of the hole required in the receiving surface to mount the trim 600. For example, the LED driver 420 may be less wide than the inner diameter of the trim 600. Conversely, the various components disposed between the AT box 410 and the trim 600 may be sized to facilitate movement of the LED driver 420.

In an embodiment, the LED driver 420 output cable pigtail 390 connects to the top of the optional AT box 410 by way of a removable electrical receptacle connector 400 that is part of a short length jumper 440 that connects the LED driver 420 to the LED light engine module 370 located inside the optional AT box 410. The short length jumper 440 may be located within the AT box 410 when in use. If an AT box 410 is not included in the downlight 310, the short length jumper 440 may be excluded as the LED light engine 370 may be directly connected to the LED driver 420. In an embodiment, the removable electrical receptacle connector 400 and/or the short length jumper 440 may be stored within or partially within the AT box 410. The short length jumper 440 may be of a sufficient length to both deliver electricity to the LED light engine module 370 and to enable movement (for example, pan and tilt) of the LED light engine module 370. The optional AT box 410 may be fastened in position by one or more flexible lock tabs 450 located on a main support ring 460. For example, the flexible lock tabs 450 may include three tabs. A hold down ring 470 may secure a pan rotation ring 480 to the main support ring 460, for example utilizing ring mounting screws 500. In an embodiment, two screw spring clips 510A/510B are fastened to opposing sides of the pan rotation ring 480 by low profile closed end type screw spring rivets 520A/520B or nuts and bolts. However, in alternate embodiments, any number or configuration of screw spring clips and/or low profile closed end type spring rivets may be provided. The pan rotation ring 480 may include at least two retractable flag lock arms 490A/490B that may be released when two long coarse screws 560A/560B are each inserted into the respective two screw guide holes 570A/570B that are provided on the pan rotation ring 480. In alternate embodiments, the pan rotation ring 480 may include any number or configuration of retractable flag lock arms, long coarse screws, or guide holes. The flag lock arms 490A/490B may be configured to maintain the position of the retrofit fixture on a ceiling by applying pressure to both the top surface and bottom surface of the ceiling. Further, the flag lock arms 490A/490B may prevent the retrofit fixture from moving once locked into position on the ceiling. As further non-limiting example, a separate plate may be installed from the bottom that attaches to the main support ring 460 and clamps at least the aforementioned components onto the receiving ceiling surface. In one embodiment, the downlight 310 may comprise one main fixture ring with the lip located on top and a separate ring from the bottom to clamp the fixture securely to the ceiling.

An LED light engine module 370 may be utilized in the second alternate embodiment of the present invention. The LED light engine module 370 may comprise a heat sink, COB or LED emitter(s), LED holder, optical lens, retainer, reflector, and Selectable Color Temperature (SCT) electronics and switching means or fixed discrete colors. The LED light engine module 370 may be attached to a tilt rotation ring holder 530 via two flat head screws 540A/540B and two friction washers 550A/550B respectively. Two long coarse thread screws 560A/560B may be provided on the tilt rotation ring holder 530 and each may be held captive with a round internal star lock washers 580A/580B. However, the tilt rotation ring holder 530 may be fastened via any number of screws, washers, and/or coarse thread screws. A separate trim gasket 590 and trim 600 may be provided, where the trim gasket 590 and/or the trim 600 are configured to attach to the tilt rotation ring holder 530 and may allow for the smooth pan and tilt rotation of the entire LED light engine module 370 that can be adjusted from below the ceiling during focusing of the improved recessed LED downlight 310. The trim gasket 590 may be used to make the luminaire WET LOCATION rated for use in a bathroom for example, and the trim 600 may be available in both round and square shapes.

Figure 3:
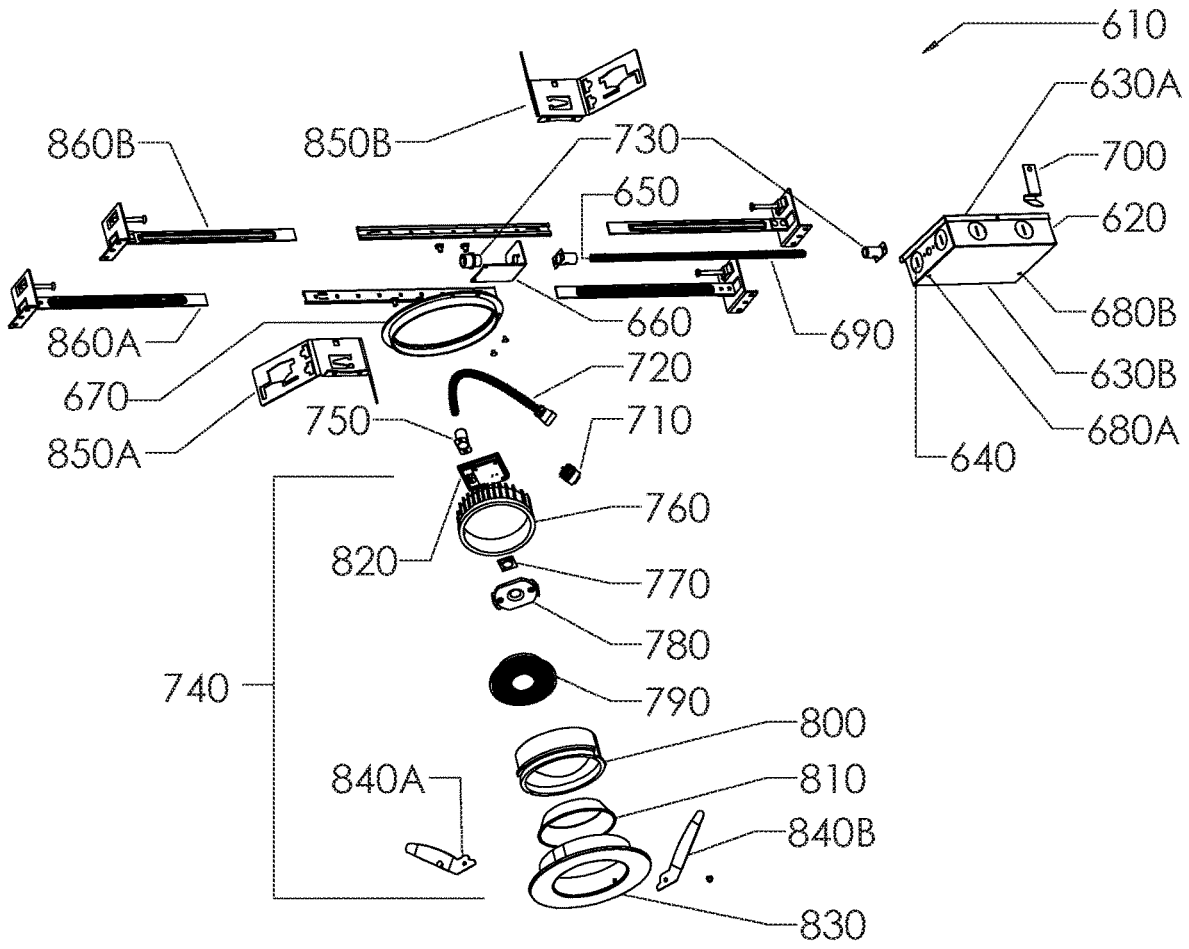
FIG. 3 is an isometric exploded view of a third embodiment of the present invention showing the improved LED downlight with enhanced features for a new construction installation.

FIG. 3 is an isometric exploded view of an alternate third embodiment of the present invention showing the improved LED downlight 610 with enhanced features for a new construction installation. In this alternate third embodiment of the present invention, an improved alternate LED downlight 610 sharing features with the improved LED downlight 10 of FIG. 1 is disclosed for use in new construction installations. Installation of the LED downlight 610 in this embodiment may be from above the ceiling. The junction box 620 and metal plate covers 630A/630B may be articulated in multiple locations and positions by utilizing an LED driver 640 located within junction box 620 and metal plate covers 630A/630B by a flexible low-voltage output cable pigtail 650 (for example, instead of rotating metal plates with hinges and retractable metal plates as provided in other embodiments). Accordingly, in such an embodiment, the junction box 620 may be sized to accept the LED driver 640. Further, the junction box 620 may include on or more openings, enabling the LED driver 620 to be in electrical communication with the flexible low-voltage output cable pigtail 650, while the metal plate covers 630A/630B are sealably interfaced with the junction box 620.

In the simplified alternate third embodiment of the present invention, an LED driver 640 output cable pigtail 650 may be provided, where the pigtail 650 is configured to connect to a ring mount bracket 660 from the junction box 620 and metal plate covers 630A/630B. The ring mount bracket 660 may be fastened securely to main support ring 670. The junction box 620 may include mounting means 680A/680B for permanent installation of the junction box 620 and metal plate covers 630A/630B to a fixed and rigid surface, such as a joist or beam; and the output cable pigtail 650 may be housed in a flexible metal armor jacket 690 that is properly connected to AC ground for continuity and electrical safety. The length of the output cable pigtail 650 may be roughly 12-18 inches long. The LED driver 640 may be mounted internal or external to the junction box 620, for example by fastening to metal plate cover 630A or 630B. A tabbed spring clip 700 may aid in locking and holding the junction box 620 metal plate covers 630A/630B in position. Other means of securing the junction box 620 metal plate covers 630A/630B include the use of screws, snaps, twist and lock, etc. In an embodiment, the LED driver 640 is replaced by removing it from the junction box 620 through the ceiling hole cutout. Accordingly, the LED driver 640 may be sized such that it may be removed through a hole in the receiving surface sized to accept the trim 830. The LED driver 640 output cable pigtail 650 may connect to the ring mount bracket 660 by way of a removable electrical receptacle connector 710. The removable electrical receptacle connector may be a component of a short length jumper 720 that connects the LED driver 640 to the LED light engine module 740.

As shown in FIG. 3, an LED light engine module 740 may also be used in this alternate third embodiment of the present invention. In an embodiment, the LED light engine module 740 comprises a heat sink 760, COB LED emitter(s) 770, holder 780, optical lens 790, retainer holder 800, reflector 810, and Selectable Color Temperature (SCT) electronics and switch 820 or fixed discrete colors. Pan and tilt movements of the COB LED emitter(s) 770 light source may be integral to the LED light engine module 740 in this alternate embodiment and such mechanisms and hardware may not be shown in FIG. 3. In an embodiment, a separate trim gasket and trim 830 is provided that attaches to the entire LED light engine module 740 that can be adjusted from below the ceiling during focusing of the improved recessed LED downlight 610. The trim gasket may be used to make the luminaire WET LOCATION rated for use in a bathroom for example. The trim 830 may be available in round, square, and other suitable shapes. In an embodiment, a pair of special flexible spring clips 840A/840B may be attached to opposing sides of the trim 830 to maintain the LED light engine module 740 and trim 830 assembly in the receiving surface. The flexible spring clips 840A/840B may be actuated with a clockwise twist to engage and spread the two flexible spring clips 840A/840B onto the top ceiling surface. Accordingly, the flexible spring clips 840A/840B may spread above the receiving surface, causing at least the trim 830 and/or the LED light engine module 740 to become affixed to the receiving surface. Thus, the flexible spring clips 840A/840B may enable installation of the downlight 610 from below the receiving surface. Further, use of the flexible spring clips 840A/840B may reduce the need for fastening the trim 830 to the receiving surface via screws or other potentially destructive fasteners.

In an embodiment, the alternate third embodiment of an improved recessed LED downlight 610 for new construction installations are constructed via the use of two butterfly brackets 850A/850B that are attached to opposing sides of the main support ring 670 to accept a pair of 3-piece hanger bar mounting arms 860A/860B for use with resident 12" and commercial 16" joist spacings, as well as 24" T-grids. The two 3-piece hangar bar mounting arms 860A/860B may each be compressed to roughly 8" in total length, and extended up to roughly 24", offering versatile mounting of the improved recessed LED downlight 610 in all types of ceiling arrangements.

Figure 4:
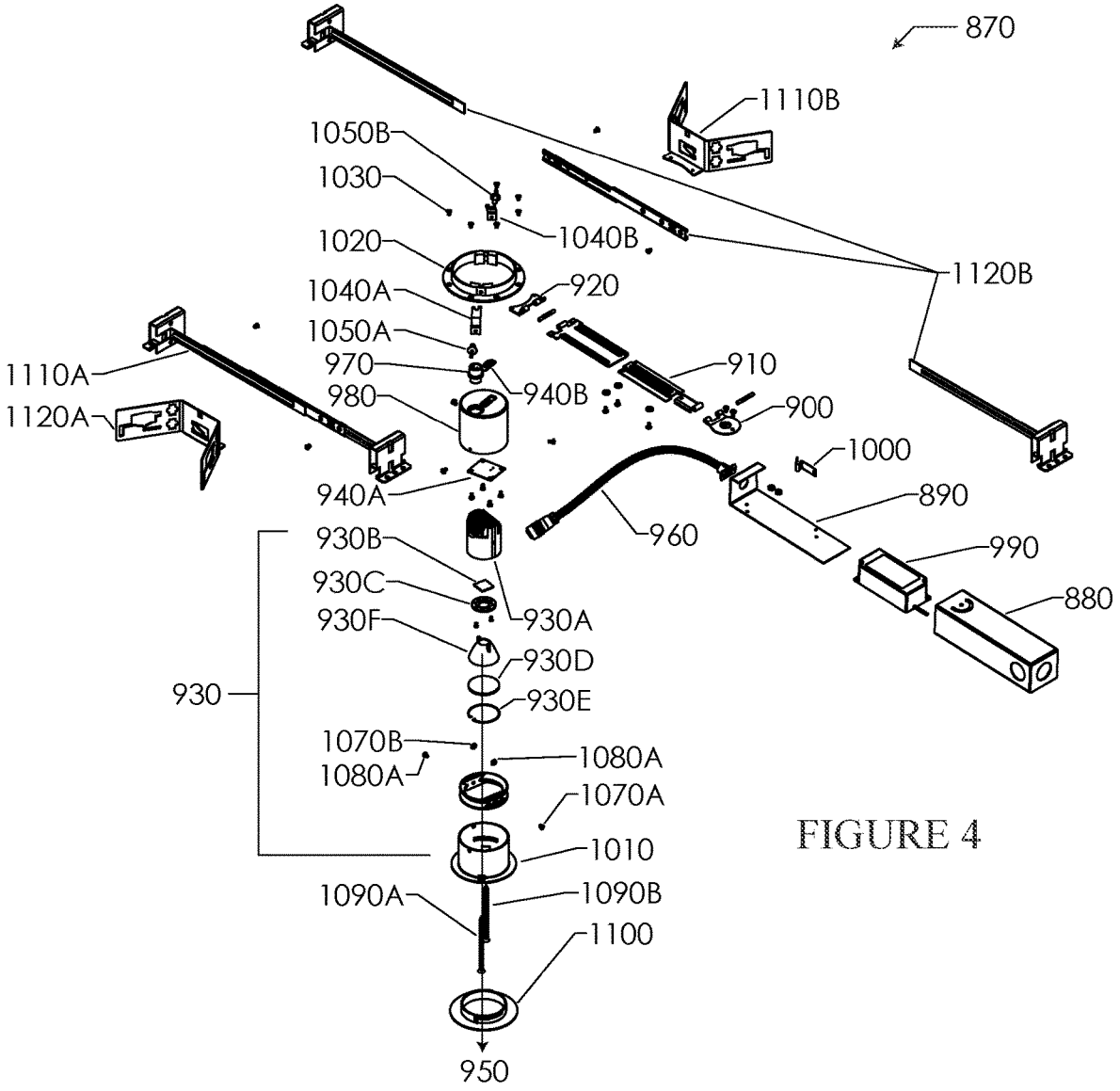
FIG. 4 is an alternate isometric exploded view of the first embodiment of the present invention of FIG. 1 showing an improved 2" diameter LED downlight with enhanced features for a new construction installation.

FIG. 4 is an alternate isometric exploded view of the preferred first embodiment of the present invention of FIG. 1 further displaying an improved 2" diameter LED downlight 870 with enhanced features for a new construction installation. In this alternate fourth embodiment of the present invention, an improved LED downlight 870 may be disclosed for use in new construction installations. Installation of the LED downlight 870 in this embodiment may be from above the ceiling. In an embodiment, the improved LED downlight 870 includes a 90-degree swivel of the junction box 880 and metal plate cover 890 with a first hinge 900 mechanism to allow it to be laid flat in parallel or perpendicular to the ceiling surface at the longest expansive stretch of all parts. In such an embodiment, the junction box 880 may comprise four sides, wherein two of the sides are opposite from one another, and the additional two sides are adjacent to one another. Further, in such an embodiment, the metal plate cover 890 may include two sides, wherein the two sides are adjacent to one another. Accordingly, the metal plate cover 890 and the junction box 880 may interface, wherein the merger of said components manifests a six-sided rectangular prism. The metal plate cover 890 may include one or more openings configured to accept the output cable pigtail 960. Thus, in order to remove or service the output cable pigtail 960, the metal plate cover 890 may be removed as opposed to the entire junction box 880. A retractable arm 910 with a second hinge 920 mechanism may allow the junction box 880 and metal plate cover 890 to be pulled or withdrawn towards the LED light engine module 930 optical axis center line 950 just above the ceiling hole cutout.

In an embodiment, an LED driver 990 low-voltage output cable pigtail 960 is provided that connects to the top electrical receptacle 970 of an optional Air-Tight AT box 980 from the junction box 880 and metal plate cover 890. The length of the output cable pigtail 960 may be approximately half the length of the fully extended fixture or roughly 12-18 inches long. The LED driver 990 may be mounted internal or external to the junction box 880 and metal plate cover 890. A single spring with a release tab 1000 may aid in locking and holding or releasing the metal plate cover 890 to the junction box 880. Other means of securing the junction box 880 to metal plate cover 890 may include the use of screws, snaps, twist and lock, etc. In a further embodiment, the LED driver 990 is replaced by removing the trim 1100 and LED light engine module 930 and gently pulling at the output cable pigtail 960 to position the junction box 880 and metal plate cover 890 through the ceiling hole cutout and pressing on the spring clip with a release tab 1000 to remove the metal plate cover 890 to gain access to the LED driver 990 in junction box 880.

The LED driver 990 output cable pigtail 960 may connect to the top of the optional AT box 980 by way of a removable top electrical receptacle 970 that may be part of a short length jumper that connects the LED driver 990 to the LED light engine module 930 located inside the optional AT box 980. The optional AT box 980 may be held in place by screws to a main support ring 1010. In a further embodiment, a pan rotation hold down ring 1020 is configured to mate to the main support ring 1010 using ring mounting screws 1030. Two screw spring clips 1040A/1040B may be fastened to opposing sides of the pan rotation hold down ring 1020 by low profile closed end type screw spring rivets 1050A/1050B or with nuts and bolts.

An MR16 sized LED light engine module 930 may be used in this fourth alternate embodiment of the present invention. The LED light engine module 930 may comprise a heat sink 930A, COB or LED emitter(s) 930B, LED holder 930C, optical lens 930D, retainer holder 930E, reflector 930F, and Selectable Color Temperature (SCT) electronics 940A and SCT switch 940B switching means, or fixed discrete colors. The LED light engine module 930 may be attached to a tilt rotation ring holder 1060 with two flat head screws 1070A/1070B and friction washers 1080A, 1080B. In an embodiment, two long coarse thread screws 1090A/1090B are provided on the tilt rotation ring holder 1060, and each are held captive with a round internal star lock friction washers 1080A/1080B. A separate trim gasket and trim 1100 may be provided that attach to the tilt rotation ring holder 1060, and may allow for the smooth pan and tilt rotation of the entire LED light engine module 930 that can be adjusted from below the ceiling during focusing of the improved recessed LED downlight 870. The trim gasket may be utilized to make the luminaire WET LOCATION rated for use in a bathroom for example, and the trim 1100 may be available in both round and square shapes.

Figure 5:
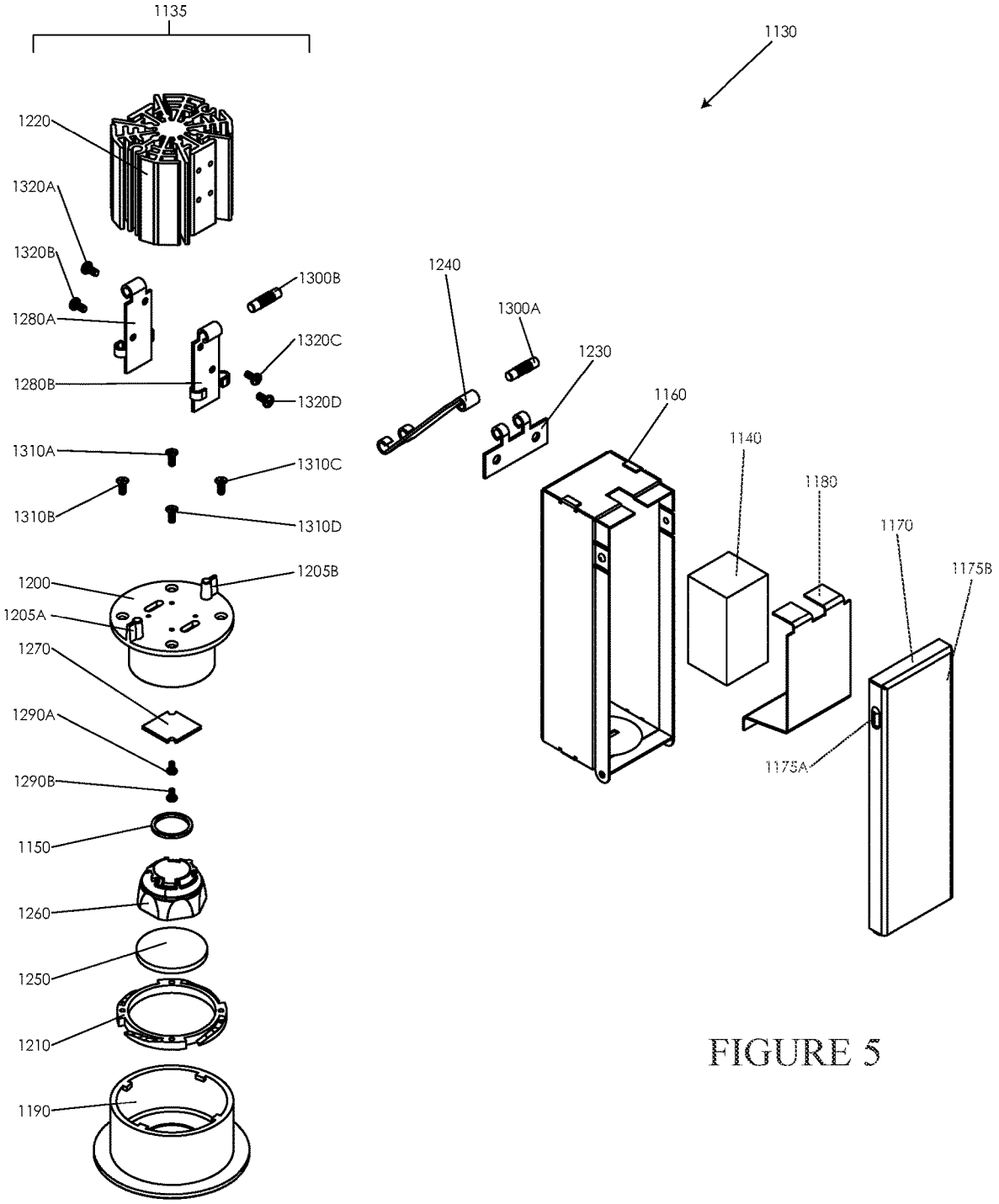
FIG. 5 is an alternate isometric exploded view of the first embodiment of the present invention of FIG. 1 showing an improved 1" diameter LED downlight with enhanced features for a remodel retrofit installation.

FIG. 5 is an alternate isometric exploded view of the first embodiment of the present invention of FIG. 1 further displaying an improved 1" diameter LED downlight 1130 with enhanced features for a remodel retrofit. In this alternate fifth embodiment of the present invention, an improved LED downlight 1130 is disclosed for use mainly in retrofit applications. Installation of the LED downlight 1130 in this embodiment may be from below the ceiling. In an embodiment, the improved LED downlight 1130 is a very compact and narrow ceiling opening fixture. In such an embodiment, the downlight 1130 may include a custom slim junction box 1160 and metal plate cover 1170. The junction box 1160 may further comprise a hinge bracket 1230 mechanism to allow it to be laid flat in parallel or perpendicular to the ceiling surface (for example, at the longest expansive stretch of all parts). An extension arm hanger 1240 with hinge spring mount brackets 1280A/1280B may allow the junction box 1160 and metal plate cover 1170 to be pulled or withdrawn towards the LED light engine assembly 1135 shown on the left in exploded view with optical axis center line just above the ceiling hole cutout.

A small and compact LED driver 1140 low-voltage output cable pigtail may be provided that connects to the junction box 1160 and metal plate cover 1170. In an embodiment, the length of the output cable pigtail is approximately 12-18 inches long. The LED driver 1140 may be mounted internal to the junction box 1160 and metal plate cover 1170, and may be shielded by a driver protective cover 1180. The driver protective cover 1180 may include one or more hanging portions configured to be captured between the top of the junction box 1160 and the cover 1170. Further, the driver protective cover 1180 may include a shelf on the lower portion sized to support the LED driver 1140. Thus, the LED driver 1140 may be accepted and may be supported by the driver protective cover 1180 when the driver protective cover 1180 is disposed between the junction box 1160 and cover 1170. Drivers may be available in a protective metal or plastic molded housing body to protect the internal electronics from damage and access. As shown in FIG. 5, the downlight 610 may be compact. Accordingly, a custom OEM driver 1140 is utilized, comprising an exposed circuit board and electronics. In some embodiments, there may be a thin paper or plastic wrap disposed around the driver 1140. Generally, the LED driver 1140 may be fragile and may manifest a potential electrical shock hazard. Thus, a separate metal or plastic protective cover (for example, the driver protective cover 1180) may be used to protect both the electrical components and also any individual conducting installation or repair work with the junction box.

Two friction locking tabs 1175A/1175B may be used to friction lock and hold, or to release the metal plate cover 1170 to the junction box 1160. In such an embodiment, the friction between the junction box 1160 and the cover 1170 at the friction locking tabs 1175A/1175B may be cover come with a reasonable force. Therefore, the friction locking tabs 1175A/1175B may maintain the cover 1170 on the junction box 1160 unless, for example, a technician is pulling the cover 1170 with a reasonable force. Other means of securing the junction box 1160 to metal plate cover 1170 include, but are not limited to, the use of screws, snaps, twist and lock, etc. In an embodiment, the LED driver 1140 is replaced by removing the trim 1190 and LED light engine assembly 1135 and gently pulling at the output cable pigtail to position the junction box 1160 and metal plate cover 1170 through the ceiling hole cutout and applying some prying action to gently remove the metal plate cover 1170 to gain access to the LED driver 1140 in junction box 1160.

In an embodiment, the main COB holder 1200 comprises two mounting posts 1205A/1205B that are pressed onto heat sink 1220. The two mounting posts 1205A/1205B may be replaced with any suitable attachment means. For example, as shown in FIG. 5, the two mounting posts 1205A/1205B may be press-fitted into holes provided in the heat sink extrusion. However, alternatively, the two mounting posts 1205A/1205B may be replaced with screw passage holes and two self-tapping screws to fasten the holder to the heat sink extrusion. In a further alternate embodiment, the attachment means may be an adhesive disposed upon the heat sink 1220. The hinge spring mount brackets 1280A/1280B may attach to opposing sides of heat sink 1220 via large pan head screws 1320A/1320B and 1320C/1320D, respectively. Two screw spring clips may be fastened to opposing sides of hinge spring mount brackets 1280A/1280B for securing the LED down light 1320 to the ceiling. Further, dowel pins 1300A/1300B may be used to connect hinge bracket 1230, extension arm 1240, and/or hinge spring mount brackets 1280A/1280B together. Thus, the junction box 1160 and/or the LED light engine assembly 1135 may swivel about the dowel 1300A axis or the dowel 1300B axis.

In an embodiment, a compact MR11 sized LED light engine assembly 1135 is used in this fifth alternate embodiment of the present invention. The LED light engine assembly 1135 may comprise a heat sink 1220, main COB holder 1200, COB LED emitter 1270, gasket 1150, reflector 1260, optical glass lens 1250, twist lock ring 1210, and/or trim 1190. The twist lock ring 1210 may be attached to the main COB holder 1200 via four flat head screws 1310A/1310B/1310C/1310D. The COB LED emitter 1270 may be secured to main COB holder 1200 and heat sink 1120 by way of two small pan head screws 1290A/1290B. In a further embodiment, a thermal element, such as a thermal paste or a thermal pad, is used for thermal transfer of heat from the COB LED emitter 1270 to the main COB holder 1200 and heat sink 1220. A separate trim gasket may be used on trim 1190 to make the downlight WET LOCATION rated for use in a bathroom for example. Further, the trim 1190 may be available in both round and square shapes.

SMD may refer to "Surface Mounted Device" LEDs. In such SMD LEDs the LED chip may be permanently fixed to a printed circuit board ("PCB"). In various embodiments, the SMD LED chips may include two or more contacts. As a non-limiting example, each diode may include an individual circuit. Accordingly, an SMD LED comprising multiple diodes (for example, three different colored diodes) may output various colors by blending and adjusting the output levels of each diode.

COB may refer to "Chip on Board." A COB LED may include more than one diode. In an embodiment, a COB LED may include a greater number of diodes than a SMD LED. As a non-limiting example, a COB LED may include nine or more diodes. Further, a COB LED may include a single circuit and two contacts, independent of the number of diodes. Accordingly, a COB LED may include a flatter structure than a SMD LED.

For the purposes of this disclosure, a COB or "chip-on-board" LED emitter may consist of multiple LED chips or diodes connected internally to form a typically round light source. A lighting fixture may utilize one COB LED emitter mounted on a substrate, or a circuit board with multiple discrete single chips, or single die LED emitters arranged in an array, so as to form a concentrated light area for best lumen output. Thus, according to the desired application, downlights as described herein may include COB LED(s) and/or SMD LED(s).

Figure 6A:
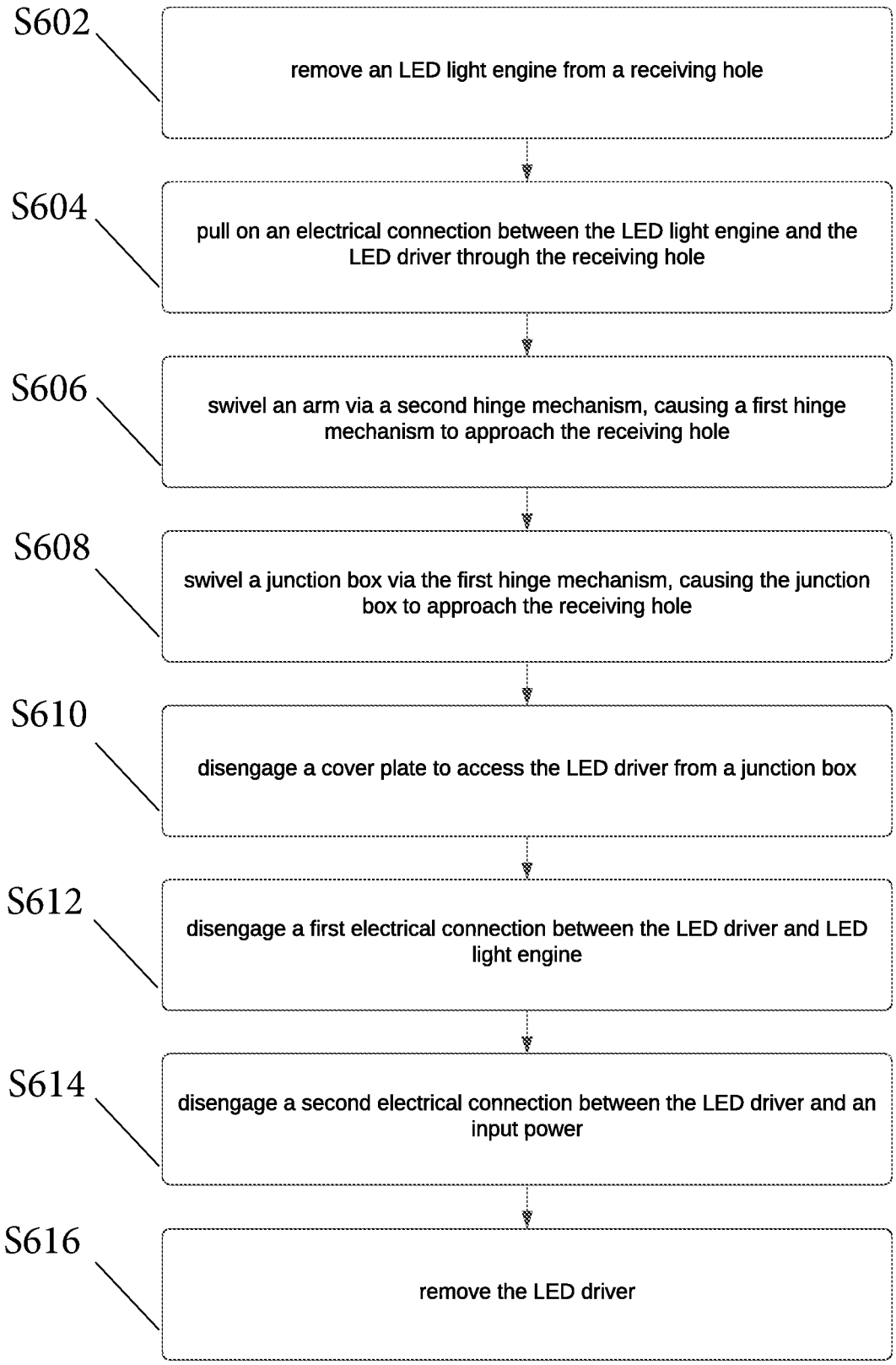
FIGS. 6A-6B illustrate flow diagrams of embodiments of methods for removing an LED driver and replacing an LED driver.

Referring to FIG. 6A the invention of the present disclosure may include a method of removing an LED driver. Such a method may begin, in step S602, by removing the LED light engine from the receiving hole. The receiving hole may be the hole created in the ceiling to accommodate the downlight. In step S604, the electrical connection between the LED light engine and the LED driver may be pulled on. For example, such a pulling force may be exerted by a user through the receiving hole. Next, in step S606, the arm may be swiveled about the second hinge mechanism, causing the first hinge mechanism to approach the receiving hole. Accordingly, in step S608, the junction box may be swiveled via the first hinge mechanism, causing the junction box to approach the receiving hole. Thus, steps S606 and S608 may include the actuation of one or more hinge mechanisms to move the junction box in closer proximity of the receiving hole. In step S610, the cover plate may be disengaged from the junction box (for example, via one or more spring clasps), enabling access to the LED driver. In alternate embodiments, the LED driver may be disposed on the outside of the junction box, wherein the LED diver may be accessed without removing the cover plate from the junction box. In step S612, a first electrical connection between the LED driver and the LED light engine may be disengaged. Additionally, in step S614, a second electrical connection between the LED driver and an input power may be disengaged. Input power may include the power as supplied by a building's electrical system. In step S616, the LED driver may be completely removed.

Figure 6B:
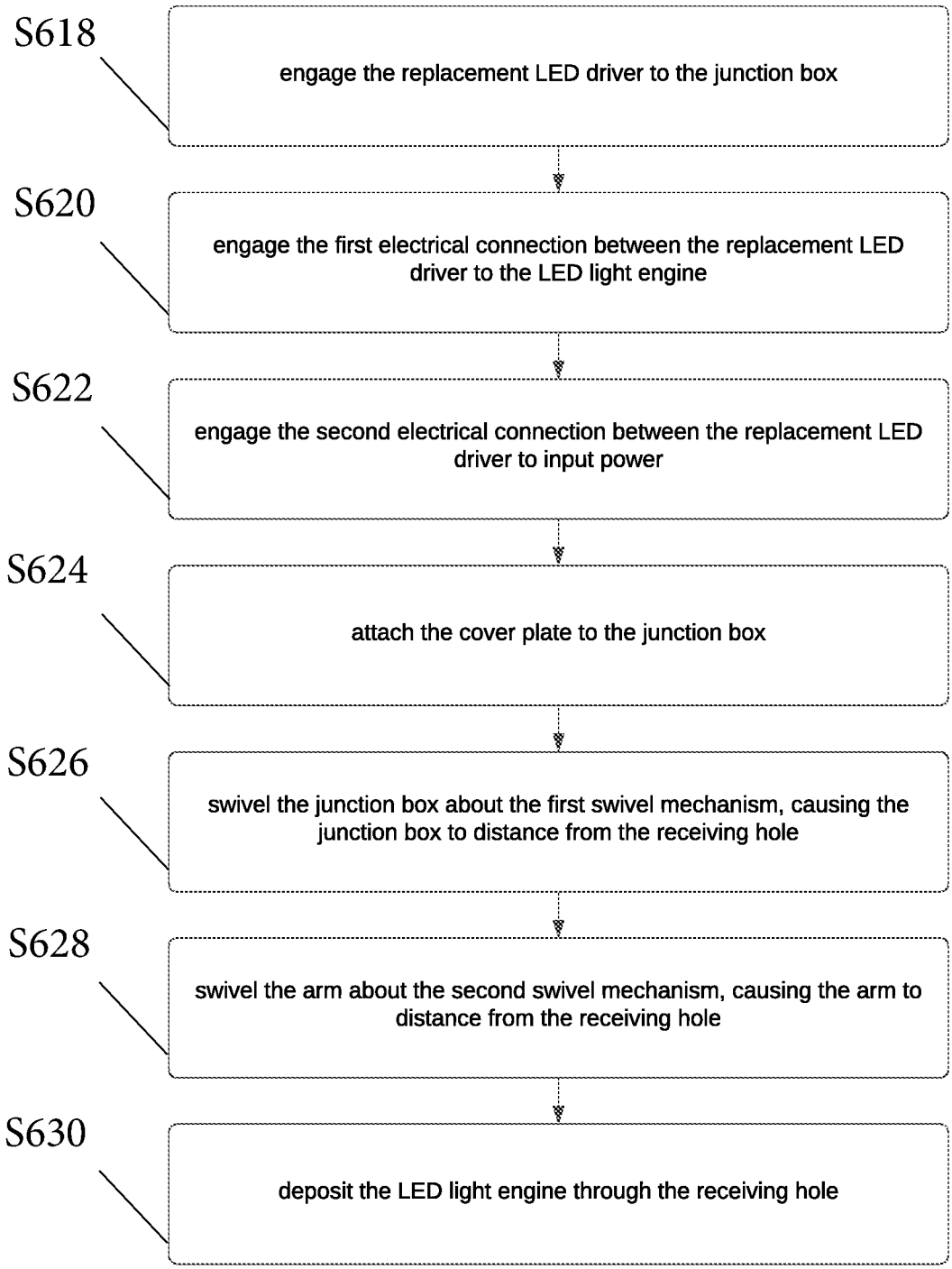

Referring to FIG. 6B the invention of the present disclosure may include a method of replacing an LED driver. Such a method may begin, in step S618, by engaging the replacement LED driver to the junction box. For example, the replacement LED driver may be affixed to one or more of the junction box's cover plates and/or internal or external to the junction box. In step S620, the first electrical connection between the replacement LED driver and the LED light engine may be engaged. Next, in step S622, the second electrical connection between the replacement LED driver and the input power may be engaged. In step S624, the cover plate may be attached to the junction box. The junction box may be swiveled about the first swivel mechanism in step S626, causing the junction box to distance from the receiving hole. Similarly, in step S628, the arm may be swiveled about the second swivel mechanism, causing the arm to distance from the receiving hole. In effect, steps S626 and S628 may utilize actuation of the first and second swivel mechanisms to move the junction box and replacement LED driver to a location clear of the receiving hole. In step S630, the LED light engine may be deposited through the receiving hole. Accordingly, power may be restored to the replacement LED driver and, more broadly, the downlight, allowing for proper function.

It will be understood that various changes in the details, materials, types, values, and arrangements of the components that have been described and illustrated in order to explain the nature of this invention may be made by those skilled in the art without departing from the principle and scope of the invention as expressed in the following claims. Finally, other implementations of the disclosure will be apparent to those skilled in the art from consideration of the specification and practice of the disclosure disclosed herein. It is intended that the specification and examples be considered as exemplary only, with a true scope and spirit of the disclosure being indicated by the following claims.

What is claimed is:

1. A downlight comprising:

a junction box bound by one or more plate covers, the junction box attached to a first hinge mechanism, wherein the first hinge mechanism is configured to swivel the junction box about the first hinge mechanism;

an arm attached to the first hinge mechanism;

a second hinge mechanism attached to the arm, wherein the second hinge mechanism is configured to swivel the arm about the second hinge mechanism;

an LED driver disposed on one of the one or more plate covers; and an LED light engine module in electrical communication with the LED driver.

2. The downlight of claim 1, further comprising:

a tilt rotation ring holder attached to the LED light engine module; and a trim attached to the tilt rotation ring holder, the trim configured to allow a tilt adjustment and a pan adjustment of the LED light engine module via tactile actuation from below a receiving surface.

3. The downlight of claim 1, further comprising:

an air tight box at least partially surrounding the LED light engine module; and an output cable pigtail attached to the air tight box via a removable top electrical receptacle and a short length jumper, the output cable pigtail facilitating the electrical communication between the LED driver and the LED light engine module.

4. The downlight of claim 3, wherein the air tight box is fastened by one or more flexible lock tabs located on a main support ring, and wherein a hold down ring secures a pan rotation ring to a main support ring.

5. The downlight of claim 4, wherein one or more butterfly brackets are attached to the hold down ring, and wherein the one or more butterfly brackets are sized to accept one or more compressible mounting arms.

6. The downlight of claim 1, the LED light engine module further comprising at least a heat sink, one or more LED emitters, a holder, an optical lens, a retainer holder, and a reflector.

7. The downlight of claim 1, wherein the one or more plate covers are affixed to the junction box via one or more tabbed springs.

8. The downlight of claim 1, wherein the LED driver is disposed internal to the junction box.

9. The downlight of claim 1, wherein the LED driver is disposed external to the junction box.

10. A downlight comprising:

a junction box disposed above a receiving surface, the junction box comprising a mounting mechanism configured to fasten the junction box to a rigid surface;

an LED driver disposed within the junction box;

an output cable pigtail extending from the LED driver, the output cable pigtail configured to attach to a ring mount bracket;

a main support ring fastened to the ring mount bracket, wherein the output cable pigtail connects to the ring mount bracket via a removable electrical receptacle connector that is integral to a short length jumper;

an LED light engine module comprising a heat sink and one or more LED emitters;

wherein pan and tilt movements of the one or more LED emitters are integral to the LED light engine module;

a trim attached to the LED light engine module, the trim configured to enable adjustment of the LED light engine module from below the receiving surface; and one or more flexible spring clips attached to the trim.

11. The downlight of claim 10, wherein the one or more flexible spring clips are configured to maintain the LED light engine module and the trim in position, and wherein the one or more flexible spring clip spread radially upon entry above the receiving surface.

12. The downlight of claim 10, wherein the output cable pigtail is housed within a grounded flexible armor jacket.

13. The downlight of claim 10, further comprising a tabbed spring comprising one or more opposing tabs, the tabbed spring configured to affix one or more plate covers to the junction box.

14. The downlight of claim 10, further comprising one or more butterfly brackets attached to the main support ring, the one or more butterfly brackets configured to accept one or more mounting arms.

15. The downlight of claim 14, wherein the one or mounting arms are compressible.

16. A downlight comprising:

a junction box sized to accept a plate cover, the junction box attached to a hinge bracket;

an extension arm swivably attached to the hinge bracket, the extension arm further attached to one or more hinge spring mount brackets, wherein the extension arm is configured to swivel about the one or more hinge spring mount brackets, and wherein the hinge bracket is configured to swivel about the extension arm;

an LED driver disposed within the junction box;

a COB holder comprising one or more attachment means, the one or more attachment means in contact with a heat sink; and a trim sized to interface with a receiving surface.

17. The downlight of claim 16, wherein the LED driver is shielded by a driver protective cover.

18. The downlight of claim 16, furthering comprising a thermal element disposed between a COB LED emitter and the COB holder and the heat sink.

19. A method for accessing an LED driver for replacement comprising the following steps:

remove an LED light engine from a receiving hole, wherein the receiving hole is bound by a receiving surface;

pull on an electrical connection between the LED light engine and the LED driver through the receiving hole;

swivel an arm via a second hinge mechanism, causing a first hinge mechanism to approach the receiving hole, wherein the arm is swivably attached to the second hinge mechanism;

swivel a junction box via the first hinge mechanism, causing the junction box to approach the receiving hole, wherein the junction box is swivably attached to the first hinge mechanism;

disengage a cover plate to access the LED driver from a junction box, wherein the cover plate is reversibly attached to the junction box;

disengage a first electrical connection between the LED driver and LED light engine;

disengage a second electrical connection between the LED driver and an input power; and remove the LED driver.

20. The method of claim 19, further comprising the steps of:

engage the replacement LED driver to the junction box;

engage the first electrical connection between the replacement LED driver to the LED light engine;

engage the second electrical connection between the replacement LED driver to input power;

attach the cover plate to the junction box;

swivel the junction box about the first hinge mechanism, causing the junction box to distance from the receiving hole;

swivel the arm about the second hinge mechanism, causing the arm to distance from the receiving hole; and deposit the LED light engine through the receiving hole.

* * * * *